US009949046B2

(12) United States Patent
Hammell

(10) Patent No.: US 9,949,046 B2
(45) Date of Patent: Apr. 17, 2018

(54) AUTOMATING REPAIRS TO AUDIO SYSTEMS

(71) Applicant: Harman International Industries, Incorporated, Stamford, CT (US)

(72) Inventor: Graham Hammell, Sandy, UT (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/215,348

(22) Filed: Jul. 20, 2016

(65) Prior Publication Data

US 2018/0027346 A1 Jan. 25, 2018

(51) Int. Cl.
*H04R 29/00* (2006.01)

(52) U.S. Cl.
CPC ..... *H04R 29/00* (2013.01)

(58) Field of Classification Search
CPC ..... H04R 29/00
USPC ..... 381/58
See application file for complete search history.

(56) References Cited

U.S. PATENT DOCUMENTS 6,108,300 A 8/2000 Coile et al.
6,965,559 B2 11/2005 Grabauskas et al.
7,392,046 B2 * 6/2008 Leib ..... H04W 24/00 455/423
2008/0316940 A1 * 12/2008 Brooks ..... H04L 12/12 370/254

OTHER PUBLICATIONS

"AudiaFUSION fault monitoring and failover", Biamp Systems, http://support.biamp.com/Audia-Nexia/Miscellaneous/AudiaFUSION/AudiaFUSION_fault_monitoring_and_failover, Jul. 20, 2016.
"Q-Sys Redundancy" QSC Audio Products LLC, http://q-syshelp.qschome.com/Content/Redundancy/001%20Q-Sys%20Redundancy.htm, Jul. 20, 2016.
"Overview of SNMP, MIB and SMI," last accessed Jul. 15, 2012, http://computernetworkingsimplified.com/application-layer/overview-snmp-mib-smi/.

(Continued)

*Primary Examiner* — Quynh Nguyen
(74) *Attorney, Agent, or Firm* — Artegis Law Group, LLP

(57) ABSTRACT

In one embodiment, a healing engine included in an audio system enables the audio system to perform self-repair operations. Upon detecting that an audio device included in the audio system has failed, the healing engine executes repair operations. First, the healing engine identifies any new audio devices added to the audio system after the failed audio device failed. The healing engine then selects one of the new audio devices as a replacement for the failed audio device. Finally, the healing engine configures the selected audio device to implement a system identity that previously identified the failed audio device with respect to the audio system. In this fashion, the healing engine replaces the failed audio device with the selected audio device. By automating the repair process, the healing engine reduces the time and effort required to restore the audio system to a fully operational state compared to conventional, manually-based techniques.

17 Claims, 4 Drawing Sheets

(56) References Cited

OTHER PUBLICATIONS

Breitbart, Yuri, Minos Garofalakis, Cliff Martin, Rajeev Rastogi, S. Seshadri, and Avi Silberschatz. "Topology discovery in heterogeneous IP networks." InINFOCOM 2000. Nineteenth Annual Joint Conference of the IEEE Computer and Communications Societies. Proceedings. IEEE, vol. 1, pp. 265-274. IEEE, 2000, Jul. 20, 2016.
"What is HiQnet?", Harman Pro, http://hiqnet.harmanpro.com/about/, Jul. 20, 2016.
"Soundweb Contrio Server", BSS Audio http://bssaudio.com/en/products/server, Jul. 20, 2016.

* cited by examiner

AUTOMATING REPAIRS TO AUDIO SYSTEMS

BACKGROUND

Field of the Invention

Embodiments of the present invention relate generally to audio systems and, more specifically, to automating repairs to audio systems.

Description of the Related Art

Many audio systems include relatively large numbers of audio devices that are deployed at various locations throughout a venue. For example, an audio system that is deployed at a stadium could include hundreds of digital signal processors, amplifiers, and speakers distributed across various rooms and floors and interconnected via multiple switches. Oftentimes, complex audio systems are initially configured by sound engineers. The sound engineers first connect the various audio devices within the system and then configure the audio devices using audio system management software. Configuring the audio devices may involve establishing identifications, downloading firmware, setting internal parameters, and so forth. Subsequently, as the audio system operates, technicians maintain the audio system. As part of maintaining the audio system, the technicians may have to re-configure one or more of the audio devices. For example, a technician may download new firmware to a given digital signal processor to improve the operation of the related audio device and the overall operation of the audio system.

Over time, various audio devices included in an audio system can fail. For each failed audio device, the technician typically identifies and locates the failed audio device, disconnects the failed audio device, and connects a replacement audio device suitable for the audio system. Subsequently, the sound engineer identifies the configuration of the failed audio device immediately before the failure. The sound engineer then configures the replacement audio device to replicate the identified configuration, which enables the replacement audio device to assume the functionality of the failed audio device. Typically, the sound engineer configures the replacement audio device via the audio system management software.

While such a manual repair process may eventually restore the audio system to the pre-failure state, the time and expertise required to repair the audio system in such a manner is substantial. For example, the audio system may be off-line or only partially operational for several weeks. Further, such a manual repair process is error-prone. For example, the sound engineer may be unable to locate and/or reproduce the correct version of firmware to download to the replacement device. In another example, before a device fails, settings and/or parameter values that are implemented in the device may be changed externally and the updated settings and/or parameter values may not be recorded. In such a scenario, after the device fails, the sound engineer may be unable to reproduce the settings and/or the parameter values. As a result, the audio system may not be able to be restored to the correct state, and the overall performance of the audio system may suffer accordingly.

As the foregoing illustrates, more effective techniques for repairing audio systems after audio device failures would be useful.

SUMMARY

One embodiment sets forth a method for automatically repairing an audio system that includes multiple audio devices. The method includes at a first time, detecting that a first audio device included in the multiple audio devices has failed based on one or more automated monitoring operations; at a second time that is later than the first time, detecting that one or more new audio devices have been added to the audio system; selecting a second audio device included in the one of more new audio devices as a replacement for the first audio device; and configuring the second audio device to implement a system identity that is associated with the first audio device and the audio system.

Further embodiments provide, among other things, a computer-readable medium and a system configured to implement the method set forth above.

At least one advantage of the disclosed techniques is that the audio system performs self-healing operations that minimize manual operations required to restore the audio system to a fully operational state after audio device failures. Notably, by automatically identifying and configuring replacement audio devices, the healing engine reduces the time that the audio system may be off-line or only partially operational compared to conventional techniques that rely primarily on the availability, speed, and skill of humans.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details.

Audio System

Figure 1:
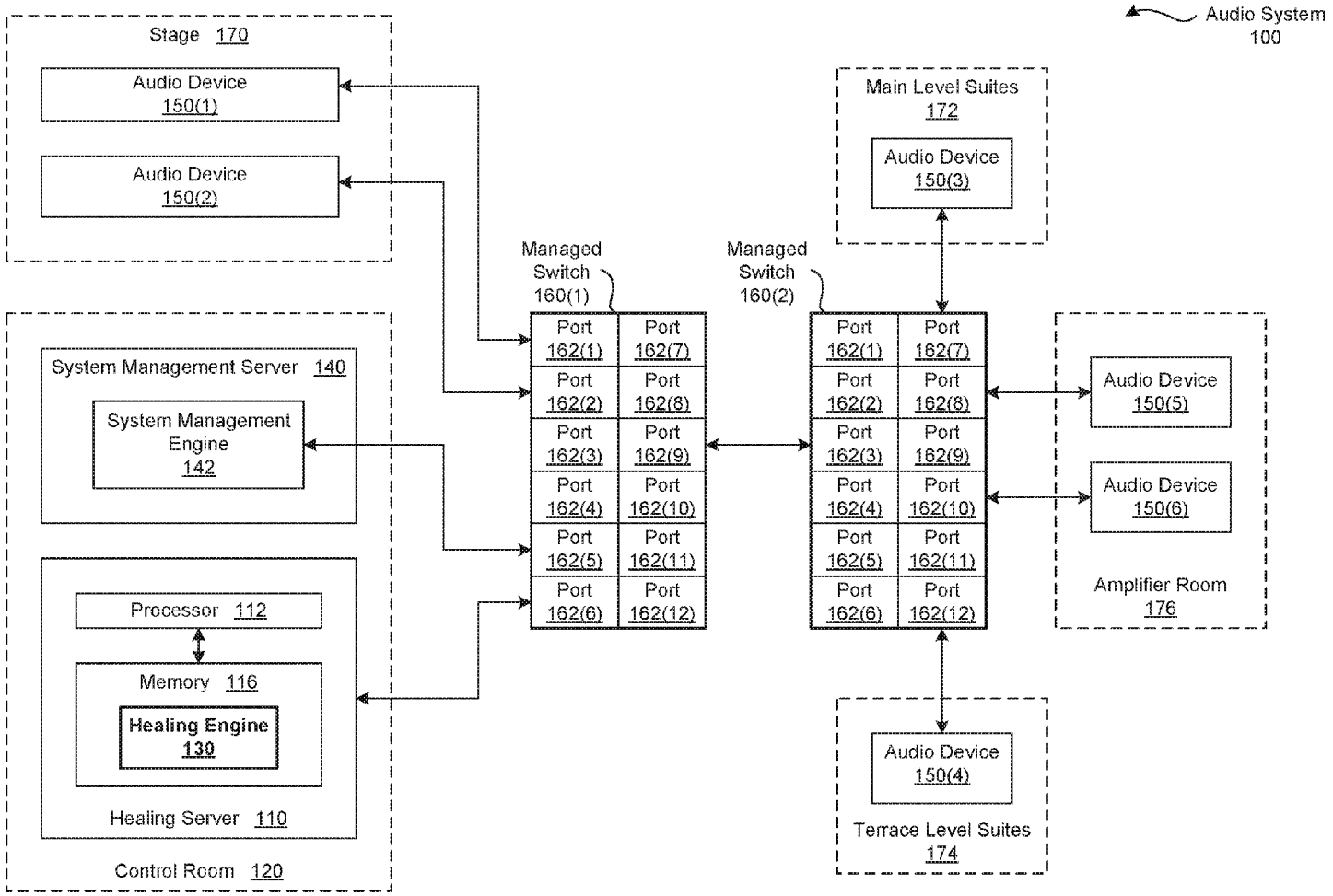
FIG. 1 illustrates an audio system configured to implement one or more aspects of the various embodiments.

FIG. 1 illustrates an audio system 100 configured to implement one or more aspects of the various embodiments. As shown, the audio system 100 includes, without limitation, audio devices 150, managed switches 160, a system management server 140 and a healing server 110. For explanatory purposes, multiple instances of like objects are denoted with reference numbers identifying the object and parenthetical numbers identifying the instance where needed. As depicted with dashed boxes, the audio devices 150(1) and 150(2) are located in a stage 170, the audio device 150(3) is located in main level suites 172, the audio device 150(4) is located in terrace level suites 174, the audio devices 150(5) and 150(6) are located in an amplifier room 176, and the system management server 140 and the healing server 110 are located in a control room 120.

In various embodiments, the audio system 100 may implement any type of audio system and include any number and type of audio-related components in any combination. Further, the components included in the audio system may be deployed in any technically feasible fashion across any number of locations in any combination in any number and types of venues. For example, in some embodiments, the audio system 100 may be a permanently installed sound system at an amusement park. In other embodiments, the audio system 100 may be a temporarily installed sound system for a rock concert at a stadium.

The audio devices 150 may include any number and type of audio-related components in any combination that are installed and interconnected through the managed switches 160. For example, and without limitation, the audio devices 150 may include digital signal processors, amplifiers, speakers, peripherals (e.g., microphones, etc.), and so forth. Further, any number of additional audio-related components may be connected to the audio devices 150, but not directly connected to the managed switches 160 in any technically feasible fashion. For example, the audio device 150(1) could be a mixer that receives input from a guitar (not shown).

As a general matter, the audio system 100 implements a network, and routing components included in the network link various components together to enable the components to share data. The audio system 100 may include any number and type of routing components. Notably, the managed switches 160 are routing components that implement configurable routing functionality. In various embodiments, the audio system 100 may include other routing components that implement configurable or fixed routing functionality. Examples of such routing components include unmanaged switches, network hubs, and repeaters, to name a few. The managed switches 160 may also provide advanced switching functionality, such as monitoring and management capabilities.

Each of the managed switches 160 includes any number of ports 162. The managed switch 160 enables the component that is connected to each of the ports 162 to share data with the other components that are directly and/or indirectly connected to the other ports 162. For instance the audio device 150(1) is connected to the port 162(1) of the managed switch 160(1), the port 162(9) of the managed switch 160(1) is connected to the port 162(3) of the managed switch 160(2), and the port 162(8) of the managed switch 160(2) is connected to the audio device 150(5). Consequently, the audio device 150(1) and the audio device 150(5) may share data. The managed switches 160 identify each of the components that are connected to the network using a media access control (MAC) address that uniquely identifies the network interface included in the component.

The network may include any number and type of communications paths that are capable of transmitting audio signals and any other signals related to the operation of the audio system. Further, the communications paths may be implemented using any number and combination of technically suitable protocols. For example, and without limitation, the network may include wired and/or wireless audio communications capabilities based on a serial protocol, an Ethernet protocol (e.g., an "Ethernet network") and/or a Universal Serial Bus (USB) protocol. Further, components within the audio system 100 may communicate in any technically feasible fashion. For example, various components may share configuration files via the File Transfer Protocol (FTP). In particular, the audio system 100 implements a "network protocol" and a "communications protocol."

As referred to herein, a network protocol enables one or more components included in the audio system 100 to communicate status data to any number of other components included in the audio system 100. For example, in some embodiments, the managed switches 160, the system management server 140, and the healing server 110 implement a Simple Network Management Protocol (SNMP). In such embodiments, the system management server 140 and the healing server 110 are configured as SNMP managers and the managed switches 170 are configured as SNMP agents. Such a configuration enables the system management server 140 and the healing server 110 to monitor the connectivity and configuration of the managed switches 170. In a complementary fashion, as referred to herein, a communications protocol enables software applications to perform management operations on the audio system 100. Such management operations include, without limitation, configuring, monitoring, and establishing system identifications for the audio devices 160 and the managed switches 170.

As shown, the system management server 140 includes, without limitation, the system management engine 142. The system management server 140 may be any compute instance that is capable of executing the system management engine 142. For example, in various embodiments the system management server 140 could be a laptop, a tablet, a smartphone, or any other device capable of executing instructions. Further, any part of the functionality of the system management server 140 and/or the system management engine 142 may be implemented in a cloud (i.e., encapsulated shared resources, software, data, etc.). The system management engine 142 is a software application that enables sound engineers to design, configure, monitor, and update the audio system 100. In some embodiments, the system management engine 142 provides a graphical user interface (not shown) that facilitates the configuration of the audio devices 150 and the managed switches 160. Notably, for each of the audio devices 150, the system management engine 142 establishes a system identification that maps the audio device 150 to the configured functionality of the audio device 150 with respect to the audio system 100. Further the system management engine 142 establishes the communications protocol. For example, in some embodiments, the system management engine 142 is "HiQnet Audio Architect™," the communications protocol is "HiQnet™," and the audio devices 150 are compatible with HiQnet Examples of audio devices 150 that are compatible with HiQnet include, without limitation, audio devices 150 that implement serial, USB, and/or Ethernet connectivity.

In general, during initialization and operation of the audio system 100, the system management engine 142 enables the sound engineer to configure any number of the audio devices 150. During initialization of the audio system 100, for each of the audio devices 142, the system management engine 142 establishes a system identification for the audio device 150 and configures any number of other identifying characteristics. For example, in some embodiments, the system management engine 142 configures the Internet Protocol (IP) addresses and the dynamic host configuration protocol (DHCP) settings. The system management engine 142 also configures the functionality of each of the audio devices 142 in any technically feasible fashion. For example, for audio devices 142 that include firmware, the system management engine 142 transfers firmware files to the audio devices 142 via FTP. In another example, for audio devices 142 that include internal configuration data, the system management engine 142 sets the values of parameters that tailor the functionality of the audio devices 142.

Subsequently, as the audio system 100 operates, technicians typically maintain the audio system 100. As part of maintaining the audio system 100, the technicians may have to re-configure any number of the audio devices 150 and/or the managed switches 160. For example, a technician may receive a new version of firmware and download the new firmware to one or more of the audio devices 150 that implement digital signal processors that are compatible with the firmware. Oftentimes, the technicians perform such updates manually, without executing the system management engine 142. Consequently, at any given point in time, the current configuration of the audio system 100 may not match the initial configuration of the audio system 100.

Over time, various audio devices 150 included in the audio system 100 can fail. For each of the failed audio devices 150, the technician typically identifies and locates the failed audio device 150, disconnects the failed audio device 150, and connects a replacement audio device 150 suitable for the audio system 100. In conventional audio systems, configuring the replacement audio devices is typically too complicated to perform manually. Consequently, for each of the failed audio devices the sound engineer attempts to identify the system identification and configuration of the failed audio device immediately before the failure. The sound engineer then identifies the corresponding replacement device and uses the system management engine to configure the replacement device based on the identified system identification and configuration.

While such a manual repair process may eventually restore a conventional audio system to the pre-failure state, the time and expertise required to repair the conventional audio system in such a manner is substantial. Accordingly, the conventional audio system may be off-line or only partially operational for several weeks. Further, such a manual process is error-prone. For example, the sound engineer may be unable to locate and/or reproduce the correct version of firmware to download to the replacement audio device. In another example, before a device fails, settings and/or parameter values that are implemented in the device may be changed externally and the updated settings and/or parameter values may not be recorded. In such examples, after a device fails, the sound engineer may be unable to reproduce the firmware, settings, and/or the parameter values to download to the replacement audio device. Consequently, the conventional audio system may not be able to be restored to the correct state, and the overall performance of the conventional audio system may suffer accordingly.

Self-Healing

To address the foregoing concerns, the audio system 100 includes the healing server 110. As shown, the healing server 110 includes, without limitation, a processor 112 and a memory 116. The processor 112 may be any instruction execution system, apparatus, or device capable of executing instructions. For example, the processor 112 could comprise a central processing unit (CPU), a graphics processing unit (GPU), a controller, a microcontroller, a state machine, or any combination thereof. The memory 116 stores content, such as software applications and data, for use by the processor 112.

The memory 116 may be one or more of a readily available memory, such as random access memory (RAM), read only memory (ROM), floppy disk, hard disk, or any other form of digital storage, local or remote. In some embodiments, a storage (not shown) may supplement or replace the memory 116. The storage may include any number and type of external memories that are accessible to the processor 112. For example, and without limitation, the storage may include a Secure Digital Card, an external Flash memory, a portable compact disc read-only memory (CD-ROM), an optical storage device, a magnetic storage device, or any suitable combination of the foregoing. As shown, the memory 116 includes, without limitation, a healing engine 130. In alternate embodiments, the audio system 100 may not include the healing server 110. In such embodiments, the healing engine 130 may be implemented (e.g., stored, executed, etc.) in a cloud, in the system management server 140, or in any other technically feasible fashion.

Figure 2:
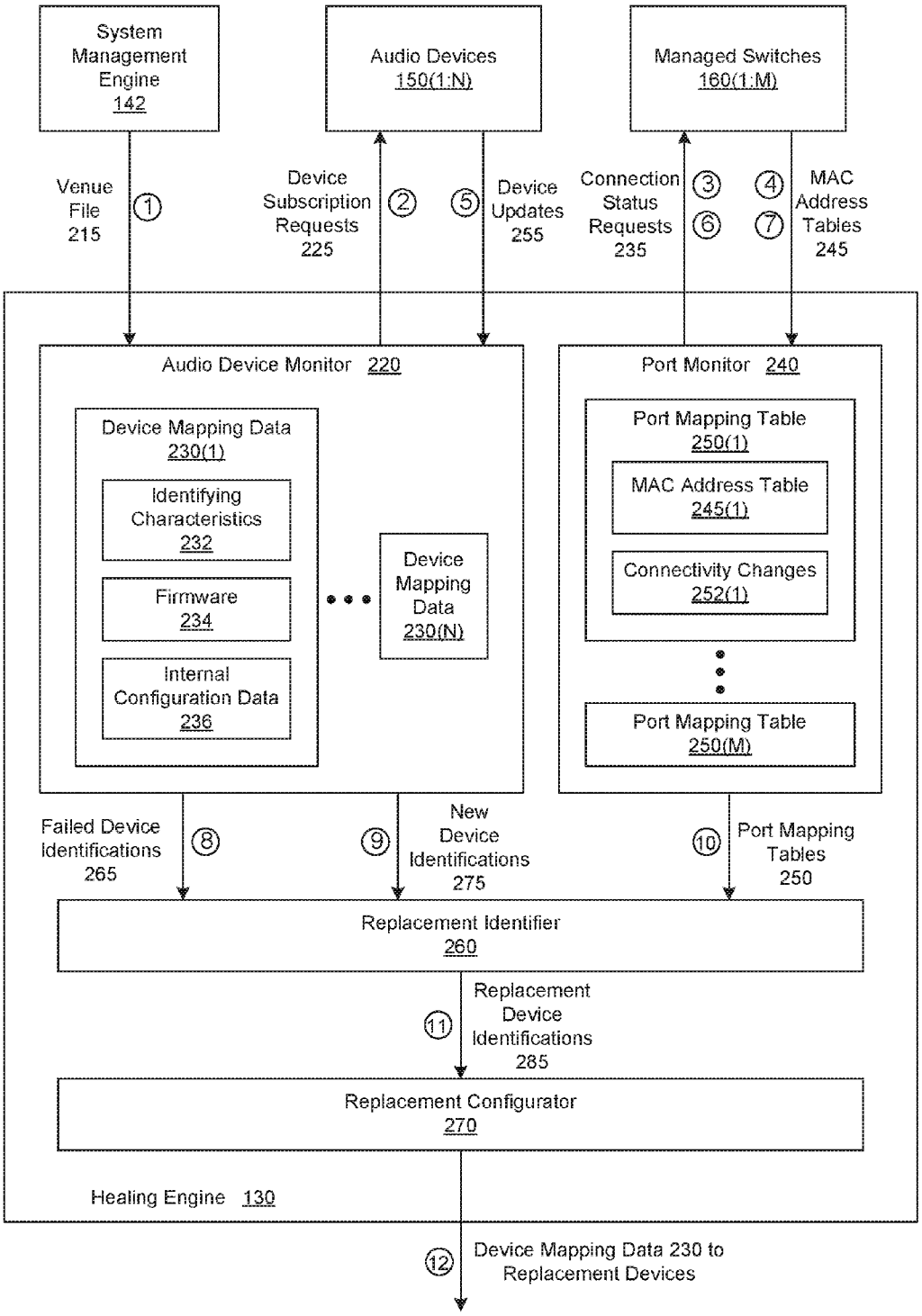
FIG. 2 is a more detailed illustration of the healing engine of FIG. 1, according to various embodiments.

FIG. 2 is a more detailed illustration of the healing engine 130 of FIG. 1, according to various embodiments. As shown, the healing engine 130 includes, without limitation, an audio device monitor 220, a port monitor 240, a replacement identifier 260, and a replacement configurator 270. For explanatory purposes only, a sequence of events involved in a "self-healing" process is depicted using numbered bubbles. In alternate embodiments, may modifications to the number of events, the sequence of events, and the events will be apparent to those of ordinary skill in the art without departing from the scope and spirit of the described embodiments. The context of FIG. 2 is that the system management engine 142 initializes the audio system 100 that includes the audio devices 150(1) through 150(N) that are interconnected through the managed switches 160(1) through 160(M).

As part of the initialization phase and as depicted with the bubble numbered "1," the system management engine 142 transmits a venue file 215 to the healing engine 130. The venue file 215 includes identification and configuration data for the audio devices 150 and the managed switches 160 included in the audio system 100. In various embodiments, the venue file 215 may specify any number and type of data in any technically feasible fashion, and the system management engine 142 may transmit the venue file 215 to the healing engine 130 using any communication path and protocol. For example, in some embodiments, the venue file 215 includes Extensible Markup Language (XML files) and the system management engine 142 transmits the venue file 215 to the healing engine 130 using FTP.

Upon receiving the venue file 215, the audio device monitor 220 stores device mapping data 230 for each of the audio devices 150. As shown for the device mapping data 230(1), each of the device mapping data 230 includes, without limitation, identifying characteristics 232, firmware 234, and internal configuration data 236. As persons skilled in the art will recognize, not all of the audio devices 150 include firmware 234 and/or internal configuration data 236. In various embodiments, the audio device monitor 220 may store any amount and type of data associated with the audio devices 150 in any technically feasible fashion.

Subsequently, as depicted with the bubble number "2," the audio device monitor 220 transmits device subscription requests 225 to the audio devices 150. In this fashion, the audio device monitor 220 "subscribes" to each of the audio devices 150. As referred to herein, after the audio device monitor 220 subscribes to a particular audio device 150, the audio device 150 is configured to transmit any functionality changes that impact the operation of the audio device 150 to the audio device monitor 220. The functionality changes may include any number of changes to the firmware 234 and/or the internal configuration data 236 in any combination. The audio devices 150 may specify and transmit the functionality changes in any technically feasible fashion.

In some embodiments, subscription functionality is included in the communications protocol implemented in the audio system 100. For example, in some embodiments, the communications protocol is HiQnet™ and the audio device monitor 220 transmits a separate device subscription request 225 to each of the audio devices 150 in a format specified by HiQnet™. In such embodiments, when parameter(s) that specify the configuration data associated with a particular audio device 150 change, the audio device 150 transmits the changed parameter(s) to the audio device monitor 220 based on a message format specified by HiQnet™.

In addition to supporting subscription functionality, in some embodiments, the communications protocol implemented in the audio system 100 provides mechanisms that automatically notify the audio device monitor 220 when each of the audio devices 150 arrives in and departs from the audio system 100. For example, if the communication protocol is HiQnet™, when a new audio device 150 is connected to the audio system 100, the new audio device 150 broadcasts an announcement message to other components, including the healing engine 130, connected to the audio system 100. In a complementary fashion, when an audio device 150 ceases communicating or is disconnected form the audio system 100, the healing engine 130 receives a message that indicates that the audio device 150 has failed.

The combination of the venue file 215, the device subscription requests 225, and the automatic arrival and departure notifications enable the audio device monitor 220 to effectively monitor the audio devices 150. For explanatory purposes, as referred to herein, device updates 255 include any number and combination of data received by the audio device monitor 220 that specify functionality changes, arrivals, and/or departure for the audio devices 150. In alternate embodiments, the audio system 100 may not implement the system management engine 142 that transmits the venue file 215 and/or a communications protocol that supports subscriptions, arrival notifications, and departure notifications. In such embodiments, the audio device monitor 220 may monitor initial configurable functionality, functionality changes, arrivals, and departures associated with the audio devices 150 in any technically feasible fashion.

As depicted with the bubble numbered "3," during the initialization phase, the port monitor 240 transmits connection status requests 235 to the managed switches 160. More specifically, for each of the managed switches 160, the port monitor 240 transmits the connection status request 235 that queries the managed switch 160 for a media access control (MAC) address table 245. The MAC address table 245 maps each of the ports 162 to the MAC address of a connected component (e.g., audio device 150, managed switch 160, etc.). In response to the connection status requests 235, each of the managed switches 160 transmits the MAC address table 245 associated with the managed switch 160 to the port monitor 240.

As a general matter, the port monitor 240 is configured to repeatedly transmit the connection status request 235 to the managed switches 160. Consequently, the port monitor 240 receives updated MAC address tables 245 on an on-going basis. In this manner, the port monitor 240 monitors the connectivity of the managed switches 160. In various embodiments, the port monitor 240 may be configured to transmit the connection status requests 235 at fixed intervals or in response to a trigger event. For example, in some embodiments, the port monitor 240 periodically transmits the connection status requests 235 based on a configurable time interval. In other embodiments, after the audio device monitor 220 receives the devices updates 255 indicating that one or more of the audio devices 150 have failed, the port monitor 240 transmits the connection status requests 235.

In some embodiments, connection status functionality is included in the network protocol. For example, in some embodiments, the network protocol is a Simple Network Management Protocol (SNMP), the healing engine 130 is configured as an SNMP manager, and the managed switches 160 are configured as SNMP agents. In such embodiments, the connection status request 235 and the MAC address table 245 conform to a message protocol defined by SNMP. In alternate embodiments, the audio system 100 may not implement a network protocol that facilitates monitoring the ports 162 of the managed switches 160. In such embodiments, the port monitor 240 may monitor the connectivity of the ports 162 of the managed switches 160 in any technically feasible fashion.

For each of the managed switches 160, after receiving the MAC address table 245, the port monitor 240 generates/updates a port mapping table 250. As shown for the port mapping table 250(1) corresponding to the managed switch 160(1), each of the port mapping tables 250 includes, without limitation, the MAC address table 245 associated with the corresponding managed switch 160 and connectivity changes 252. Initially, as depicted by the bubble numbered "4," the port monitor 240 sets the connectivity changes 252 to specify no changes. Upon receiving an updated MAC address table 245 as depicted by the bubble numbered "7," the port monitor 240 updates the connectivity changes 252 based on the stored MAC address table 245 prior to storing the updated MAC address table 245. In this fashion, the port monitor 240 tracks any connectivity changes to the ports 252 of the managed switches 250. As a general matter, the port monitor 240 tracks the MAC address of previously connected components. In various embodiments, the port monitor 240 may track any amount and type of relevant port connectivity information in any technically feasible fashion. For example, in some embodiments, the port monitor 240 tracks the previous MAC address and the time of any connectivity changes.

The sequence of events associated with the bubbles numbered "1"-"4," are included in the initialization phase of the self-healing process. In alternate embodiments, many modifications and variations on the functionality and sequence of events included in the initialization phase will be apparent to those of ordinary skill in the art without departing from the scope and spirit of the described embodiments. For example, in some embodiments, the audio device monitor 220 transmits the initial device subscription requests 225 and the port monitor 240 transmits the connection status requests 235 substantially in parallel.

After the initialization phase and as depicted with the bubble numbered "5," the audio device monitor 220 repeatedly receives the device updates 255 as the audio system 100 operates. In response to the device updates 255, the audio device monitor 220 updates the device mapping data 230. In this fashion, the audio device monitor 220 ensures that the device mapping data 230 reflects the current configuration of each of the audio devices 150. Similarly, as depicted with the bubbles numbered "6" and "7," the port monitor 240 repeatedly transmits the connection status requests 235 and receives the MAC address tables 245 as the audio system 100 operates. After receiving updated MAC address tables 245, the port monitor 240 updates the connectivity changes 252 based on the stored MAC address tables 245 to preserve previous connectivity information and then stores the updated MAC address tables 245. In this fashion, the sequence of events associated with the bubbles numbered "5"-"7" are included in a monitoring phase of the self-healing process. In alternate embodiments, many modifications and variations on the functionality and sequence of events included in the monitoring phase will be apparent to those of ordinary skill in the art without departing from the scope and spirit of the described embodiments.

If the audio device monitor 220 receives the device updates 255 that indicate that one or more of the audio devices 150 have failed, then the healing engine 130 executes a sequence of events associated with a healing phase of the self-healing process. More specifically, as depicted with the bubble numbered "8," the audio device monitor 220 identifies one or more of the audio devices 150 that have failed based on the device updates 255 and conveys failed devices identifications (IDs) 265 to the replacement identifier 260. For explanatory purposes, audio devices 150 that have failed are also referred to herein as "failed" audio devices 150.

Subsequently, as depicted with the bubbled numbered "9," the audio device monitor 220 generates one or more new device identifications 275 based on the device updates 255, and conveys the new device identifications (IDs) 275 to the replacement identifier 260. In particular, the audio device monitor 220 sets the new device identifications 275 to specify the audio devices 150 that arrive (i.e., are connected to) the audio system 100 after the audio devices 150 specified by the failed device identifications 265 failed. In this fashion, the audio device monitor 220 sets the new device identifications 275 to include the audio devices 150 that technicians connect to the managed switches 160 to replace the failed audio devices 265.

As depicted with the bubble numbered "10," in addition to the failed device identifications 265 and the new device identifications 275, the replacement identifier 260 also receives the port mapping tables 250. Upon receiving the failed device identifications 265, the new device identifications 275, and the port mapping tables 250, the replacement identifier 260 generates replacement device identifications 285. Each of the replacement device identifications 285 is associated with a failed audio device 150 and specifies a corresponding "replacement" audio device 150. In general, for each of the failed audio devices 150 specified by the failed device identifications 265, the replacement identifier 260 selects one of the audio devices 150 specified by the new device identifications 275 as the corresponding replacement audio device 150. The replacement identifier 260 then sets the replacement device identification 285 associated with the failed audio device 150 to specify the replacement device 150.

More precisely, for a given failed audio device 150, the replacement identifier 260 selects the port 162 of the managed switch 160 previously connected to the failed audio device 150 based on the port mapping tables 250. The replacement identifier 260 may select the port 162 of the managed switch 160 in any technically feasible fashion. For example, in some embodiments, the replacement identifier 260 performs comparison operations between the MAC address for the failed audio device 150 and the connectivity changes 252 to determine the port 162 of the managed switch 160 that was previously connected to the failed audio device 150.

The replacement identifier 260 then determines whether any of the audio devices 150 specified by the new device identifications 275 are connected to the selected port 162 of the managed switch 160. The replacement identifier 260 may attempt to identify such a replacement audio device 150 in any technically feasibly fashion. For example, in some embodiments, the replacement identifier 260 performs a look up operation on the MAC address tables 245 to select the MAC address of the audio device 150 currently connected to the selected port 162 of the managed switch 160. Subsequently, the replacement identifier 260 compares the selected MAC address to the MAC address for each of the audio devices 150 specified by the new device identifications 175. If the MAC address for the audio device 150 specified by one of the new device identifications 175 matches the selected MAC address, then the replacement identifier 260 selects the audio device 150 as a potential replacement audio device 150.

The replacement identifier 260 then determines whether the hardware of the potential replacement audio device 150 is compatible with the hardware of the corresponding failed audio device 150. The replacement identifier 260 may perform any number of comparison operations (including zero) in any combination and in any technically feasible fashion to determine whether the potential replacement audio device 150 is hardware compatible with the corresponding failed audio device 150. Further, the number and type of comparison operations may vary based on the type and/or functionality of the failed audio device 150. For example, in some embodiments, if the failed audio device 150 is a microphone, then the replacement identifier 260 is configured to determine that the potential replacement audio device 150 is compatible with the failed audio device 150 without performing any comparison operations. By contrast, in some embodiments, if the failed audio device 150 is an amplifier, then the replacement identifier 260 is configured to compare power levels to determine whether the failed audio device 150 and the potential replacement audio device 150 are compatible. Further, for some failed audio devices 150, the replacement identifier 260 compares hardware elements, such as add-on cards to determine whether the failed audio device 150 and the potential replacement audio device 150 are compatible.

If the replacement identifier 260 determines that the potential replacement audio device 150 is compatible with the failed audio device, then the replacement identifier 260 selects the potential audio device 150 as the replacement audio device 150 for the failed audio device 150. The replacement identifier 260 then sets the replacement device identification 285 associated with the failed audio device 150 to specify the replacement audio device 150. If, however, the replacement identifier 260 determines that the potential replacement audio device 150 is not compatible with the failed audio device, then the replacement identifier 260 does not automatically identify the replacement audio device 150 for the failed audio device 150.

If the replacement identifier 260 is unable to automatically identify the replacement audio devices 150 for a particular failed audio device 150, then the replacement identifier 260 is configured to obtain the replacement device identification 285 from an external source. For example, in some embodiments, the replacement identifier 260 transmits the failed device identification 265 and the new device identifications 275 to the system management engine 142 for display purposes. The system management engine 142 displays the failed device identification 265 and the new device identifications 275 and prompts the sound engineer or technician to select the replacement audio device 150 for the failed audio device 150. The system management engine 142 then transmits the corresponding replacement device identification 285 to the replacement identifier 260.

As depicted with the bubble numbered "11," the replacement configurator 270 receives the replacement device identifications 285. Subsequently, as depicted with the bubble numbered "12," for each of the replacement device identifications 285, the replacement configuration 270 transmits the device mapping data 230 associated with the failed audio device 150 to the replacement audio device 150. In this fashion, for each of the replacement device identifications 285, the replacement configuration 270 configures the replacement audio device 150 specified by the replacement device identification 285 to assume the identity and functionality of the corresponding failed audio device 150 with respect to the audio system 100. For explanatory purposes, as referred to herein, the replacement device identification 285(*x*) specifies the replacement audio device 150(*r*) associated with the failed audio device 150(*f*).

To process the replacement device identification 285(*x*), the replacement configurator 270 first selects the device mapping data 230 associated with the failed audio device 150(*f*). The replacement configurator 270 then configures the replacement audio device 150(*r*) based on the identifying characteristics 232 included in the selected device mapping data 230. In addition to a system identification for the failed audio device 150(*f*), the identifying characteristics 232 may include any other type of information in any format. For example, in some embodiments, the identifying characteristics 232 also include an Internet Protocol (IP) address and dynamic host configuration protocol (DHCP) settings. The replacement configurator 270 may configure the replacement audio device 150(*r*) in any technically feasible fashion. For example, in some embodiments, the replacement configurator 270 may transmit a message to the replacement audio device 150(*r*) that includes the identifying characteristics 232 associated with the failed audio device 150(*f*). Upon receiving such a message, the replacement audio device 150(*r*) modifies characteristics of the replacement audio device 150(*r*) based on the content of the message. In this manner, the replacement audio device 150(*r*) assumes the identity of the failed audio device 150(*f*) with respect to the audio system 100.

Subsequently, the replacement configurator 270 determines whether the selected device mapping data 230 specifies the firmware 234. In general, the firmware 234 may include any number and type of files, and each file may have an associated version. If the replacement configurator 270 determines that the selected device mapping data 230 specifies the firmware 234, then the replacement configurator 270 transmits the firmware 234 to the replacement audio device 150(*r*). The replacement configurator 270 may transmit the firmware 234 in any technically feasible fashion. For example, in some embodiments, the replacement configurator 270 transmits the firmware 234 to the replacement audio device 150(*r*) via FTP. Upon receiving the firmware 234, the replacement audio device 150(*r*) typically self-updates and reboots. In alternate embodiments, the replacement configurator 270 may transmit only the subset of the firmware 234 that is different than the firmware that is implemented in the replacement audio device 150(*r*). If, however, the replacement configurator 270 determines that the selected device mapping data 230 does not specify the firmware 234, then the replacement configurator 270 does not update any firmware that is implemented in the replacement audio device 150(*r*). Such a scenario may occur if the failed audio device 150(*r*) does not implement any firmware.

Finally, the replacement configurator 270 determines whether the selected device mapping data 230 specifies the internal configuration data 236. In general, the internal configuration data 236 may specify any configurable functionality in any technically feasible fashion. For example, in some embodiments, the internal configuration data 236 may include any number of parameters stored in the form of XML files. If the selected device mapping data 230 specifies the internal configuration data 236, then the replacement configurator 270 transmits the internal configuration data 236 to the replacement audio device 150(*r*). The replacement configurator 270 may transmit the internal configuration data 236 in any technically feasible fashion. For example, in some embodiments, the replacement configurator 270 transmits XML files to the replacement audio device 150(*r*) via FTP. Upon receiving the internal configuration data 236, the replacement audio device 150(*r*) performs update operations based on the internal configuration data 236. As a result of the update operations, the replacement audio device 150(*r*) assumes the functionality that the failed audio device 150(*f*) implemented prior to failing.

The sequence of events associated with the bubbled numbered "8"-"12" are included in the healing phase included in the self-healing process. In general, during the healing phase, the replacement configurator 270 ensures that each of the replacement audio devices 150 assumes the identity and functionality of the corresponding failed audio device 150. In alternate embodiments, many modifications and variations on the functionality and sequence of events included in the healing phase will be apparent to those of ordinary skill in the art without departing from the scope and spirit of the described embodiments. For example, in some embodiments, the replacement configurator 270 may perform a variety of checks during the healing phase and, if any of the checks fail, then the healing engine 130 may terminate the self-healing process.

In particular, in some embodiments, if the replacement configurator 270 is unable to configure a particular replacement audio device 150 to assume the identity of the corresponding failed audio device 150, then the healing engine 130 terminates the self-healing process. In such a scenario, the replacement configurator 270 does not attempt to update the firmware 234 and/or the internal configuration data 236 of the replacement audio device 150. Similarly, if the replacement configuration 270 is able to configure a particular replacement audio device 150 to assume the identity of the corresponding failed audio device 150 but is unable to update the firmware 234, then the healing engine 130 terminates the self-healing process. In such a scenario, the replacement configurator 270 does not attempt to update the internal configuration data 236 of the replacement audio device 150.

The healing engine 130 is configured to repeatedly execute the monitoring and healing phases of the self-healing process to maximize the amount of time that the audio system 100 is fully functional. As persons skilled in the art will recognize, the healing engine 130 may execute any number of the operations included in the monitoring and healing phases concurrently, sequentially, and in any combination. For example, while the replacement configurator 270 is configuring the replacement audio device 150(3) to assume the identity of the failed audio device 150(11), the replacement identifier 160 may be identifying that the audio device 150(132) is the replacement for the failed audio device 150(48).

Note that the techniques described herein are illustrative rather than restrictive, and may be altered without departing from the broader spirit and scope of the invention. For example, in alternate embodiments, the audio system 100 may not implement SNMP and the healing engine 130 may not include the port monitor 240 and/or the replacement identifier 260. After detecting the failed audio devices 150, instead of automatically determining the replacement device identifications 285 based on the connectivity of the ports 162 of the managed switches 160, the healing engine 130 may receive external inputs that specify the replacement device identifications 285. In other embodiments, the audio system 100 includes both the managed switches 160 and unmanaged switches. In such embodiments, the replacement identifier 260 may automatically determine the replacement device identifications 285 for the audio devices 150 that are connected to the managed switches 160 and receive external inputs that specify the replacement device identifications 285 for any remaining audio devices 150.

Figure 3:
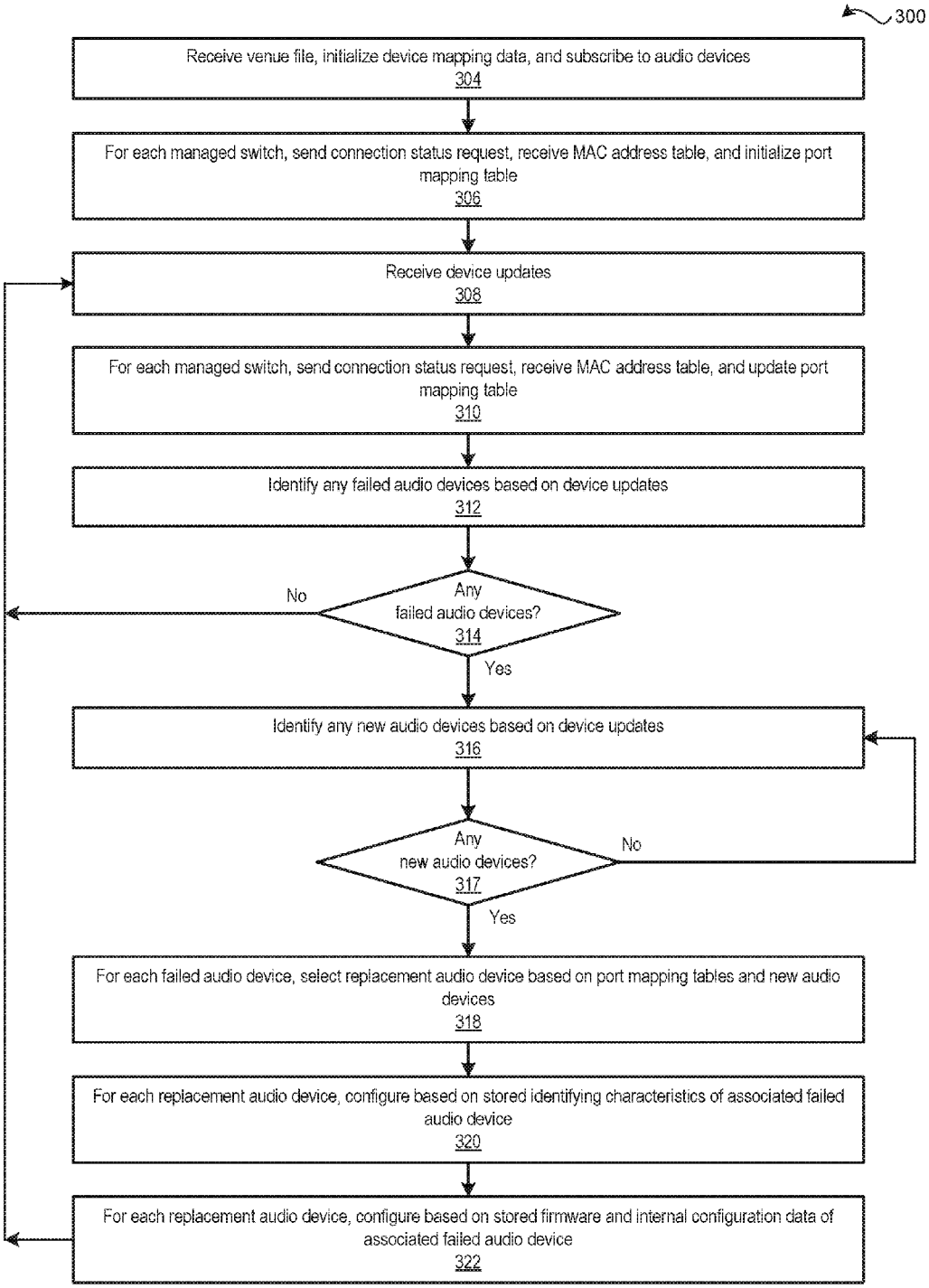
FIG. 3 is a flow diagram of method steps for repairing an audio system, according to various embodiments.

FIG. 3 is a flow diagram of method steps for repairing an audio system, according to various embodiments. Although the method steps are described in conjunction with the systems of FIGS. 1-2, persons skilled in the art will understand that any system configured to implement the method steps, in any order, falls within the scope of the present invention. The context of FIG. 2 is that the system management engine 142 configures the audio system 100.

As shown, a method 300 begins at step 304, where the audio device monitor 220 receives the venue file 215 from the system management engine 142. In general, the system management engine 142 transmits the venue file 215 to the audio device monitor 220 as part of initializing the audio system 100. In response to receiving the venue file 215, for each of the audio devices 150, the audio device monitor 220 initializes the associated device mapping data 230. The device mapping data 230 includes, without limitation, the identifying characteristics 232, the firmware 234, and the internal configuration data 236. Notably, the identifying characteristics 232 includes the system identification that maps the audio device 150 to the configured functionality of the audio device 150 with respect to the audio system 100. Further, for each of the audio devices 150, the audio device monitor 220 transmits the device subscription request 225 to the audio device 150. In this fashion, the audio device monitor 220 subscribes to the audio devices 150 and, consequently, receives the device updates 225 from the audio devices 150 whenever any configurable functionality of the audio devices 150 changes.

At step 306, for each of the managed switches 160 included in the audio system 100, the port monitor 240 transmits the connection status request 235 and, in response, receives the MAC address table 245. For each of the managed switches 160, the port monitor 240 initializes a corresponding port mapping table 250 to store the received MAC address tables 245 and sets the connectivity changes 252 included in the port mapping table 250 to specify no changes. In this fashion, the port monitor 240 initiates a monitoring of the managed switches 160.

At step 308, the audio device monitor 220 receives the device updates 255 from one or more of the audio devices 150. In response to the device updates 255, the audio device monitor 220 updates the device mapping data 230. Accordingly, the audio device monitor 220 ensures that the device mapping data 230 reflects the current configuration of each of the audio devices 150. At step 310, the port monitor 240 re-transmits the connection status requests 235 and, in response, receives the updated MAC address tables 245. After receiving updated MAC address tables 245, the port monitor 240 updates the connectivity changes 252 based on the stored MAC address tables 245 to preserve previous connectivity information and then stores the updated MAC address tables 245.

At step 312, the audio device monitor 220 determines whether any of the audio devices 150 have failed based on the devices updates 255. If, at step 314, the audio device monitor 220 determines that none of the audio devices 150 have failed, then the method 300 returns to step 308, where the audio device monitor 220 receives new device updates 255. The healing engine 130 continues to cycle through steps 308-314, monitoring the audio devices 150 and the managed switches 160, until the audio device monitor 220 determines that one or more of the audio devices 150 have failed. If, however, at step 314, the audio device monitor 220 determines that one or more of the audio devices 150 have failed, then the method 300 proceeds to step 316. As described previously herein, the audio devices 150 that have failed are referred to as the failed audio devices 150. As part of identifying the failed audio devices 150, the audio device monitor 220 generates the failed device identifications 265 that specified the failed audio devices 150.

At step 316, the audio device monitor 220 identifies any new audio devices 150 connected to the audio system 100 after the failed audio devices 150 failed based on the device updates 255. As persons skilled in the art will recognize, while the audio device monitor 220 is executing step 316, the healing engine 130 may concurrently execute any number of steps 308-316 in any combination as part of continuously monitoring the audio devices 150 and/or the managed switches 160. As part of identifying the new audio devices 150, the audio device monitor 220 generates the new device identifications 275 that specify the new audio devices 150.

At step 317, the audio device monitor 220 determines whether the audio device monitor 220 has identified any new audio devices 150. If, at step 317, the audio device monitor 220 determines that no new audio devices 150 have been connected to the audio system 100, then the method 300 returns to step 316, where the audio device monitor 220 receives new device updates 255. The audio device monitor 220 continues to cycle through steps 316-317, receiving and evaluating the device updates 225 until the audio device monitor 220 identifies that one or more new audio devices 150 have been connected to the audio system 100. In this fashion, the audio device monitor 220 "waits" for a technician to connect new audio devices 150 to the audio system 100. If, however, at step 317, the audio device monitor 220 determines that one or more new audio devices 150 have been connected to the audio system 100, then the method 300 proceeds to step 318.

At step 318, for each of the failed audio devices 150 specified by the failed device identifications 265, the replacement identifier 260 selects the corresponding replacement audio device 150. In general, for each of the failed audio devices 150, the replacement identifier 260 generates the associated replacement device identification 285 that specifies the replacement audio device 150. The replacement identifier 260 generates the replacement device identifications 285 based on the port mapping tables 250 and the new audio devices 150 specified by the new device identifications 275 in any technically feasible fashion. For example, in some embodiments, the replacement identifier 260 implements the method steps of FIG. 4 (described below) to generate the replacement devices identifications 285.

At step 320, for each of the replacement audio devices 150 specified by the replacement device identifications 285, the replacement configurator 270 configures the replacement audio device 150 based on the stored identifying characteristics 232 of the corresponding failed audio device 150. Because the audio device monitor 220 continually updates the stored identifying characteristics 232 of the audio devices 150, the stored identifying characteristics 232 are up-to-date. Notably, during step 320, the replacement configurator 270 configures each of the replacement audio devices 150 to assume the identity of the corresponding failed audio device 150 with respect to the audio system 100.

At step 322, the replacement configurator 270 configures the replacement audio devices 150 based on the stored firmware 234 and the stored internal configuration data 236 of the corresponding failed audio devices 150. Because the audio device monitor 220 continually updates the stored firmware 234 and the stored internal configuration data 236 of the audio devices 150, the stored firmware 234 and the stored internal configuration data 236 are up-to-date. During step 322, the replacement configurator 270 configures each of the replacement audio devices 150 to assume the functionality of the corresponding failed audio device 150 with respect to the audio system 100. The method 300 then returns to step 308, where the audio device monitor 220 receives new device updates 255. The healing engine 130 continues to cycle through steps 308-322, automatically configuring new audio devices 150 to replace failed audio devices 150, until the audio system 100 and/or the healing engine 130 are disabled. As persons skilled in the art will recognize, the healing engine 130 may concurrently execute any number of steps 308-322 in any combination as part of continuously monitoring the audio devices 150, monitoring the managed switches 160, and replacing failed audio devices 150.

In alternate embodiments, the healing engine 130 may not monitor the managed switches 160. In such embodiments, the healing engine 130 may not include the port monitor 240 and the healing engine 130 may not execute steps 306 and 310. Further, at step 318, the healing engine 130 may identify the replacement audio devices 150 in any technically feasible fashion that does not involve the port mapping tables 250. For example, in some embodiments, the replacement identifier 260 may configure the system management engine 142 to prompt the sound engineer or technician to select the replacement audio devices 150 based on the failed device identifications 265 and/or the new device identifications 275.

Figure 4:
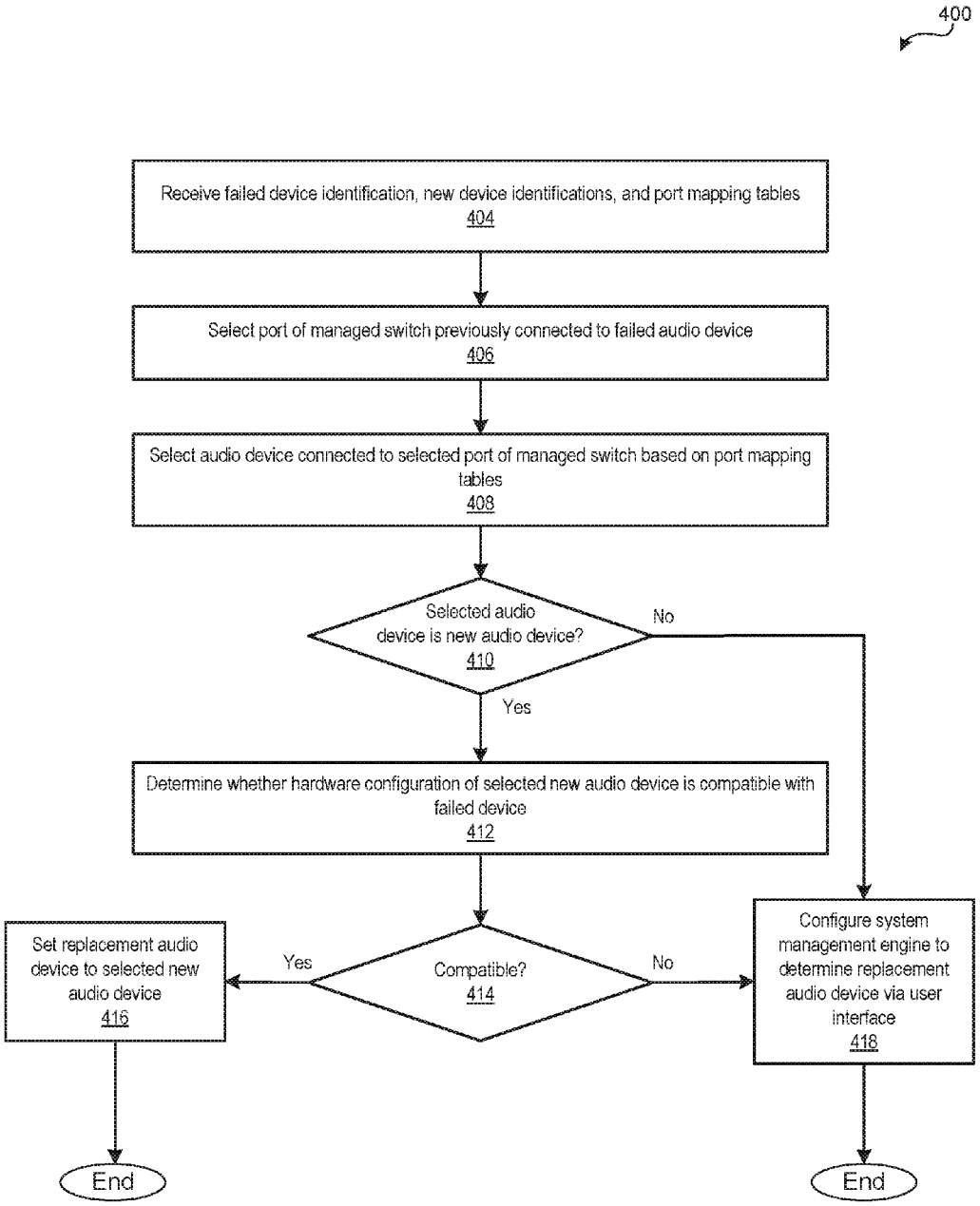
FIG. 4 is a flow diagram of method steps for selecting a replacement audio device for a failed audio device, according to various embodiments.

FIG. 4 is a flow diagram of method steps for selecting a replacement audio device for a failed audio device, according to various embodiments. Although the method steps are described in conjunction with the systems of FIGS. 1-2, persons skilled in the art will understand that any system configured to implement the method steps, in any order, falls within the scope of the present invention.

As shown, a method 400 begins at step 404, where the replacement identifier 260 receives one of the failed device identifications 265 and the new device identifications 275 from the audio device monitor 220, and the port mapping tables 250 from the port monitor 240. For discussion purposes only, it is assumed in this description of FIG. 4 that the failed device identification 265, the new device identifications 275, and the port mapping tables 250 are generated in any technically feasible fashion in any format. For example, the healing engine 130 could implement the method steps 304-316 of FIG. 3 to generate the failed device identification 265, the new device identifications 275, and the port mapping tables 250.

At step 406, the replacement identifier 260 selects the port 162 of the managed switch 160 that was previously connected to the failed audio device 150 specified by the failed device identification 265 based on the connectivity changes 252 included in the port mapping tables 250. As described previously herein, the connectivity changes 252 specify the previous mapping between the failed audio device 150 and the port 162 of the managed switch 160. Consequently, when the failed audio device 150 is disconnected from the port 162 of the managed switch 160, the port monitor 240 updates the connectivity changes 252 to specify the previous mapping of the failed audio device 150 to the port 162 of the managed switch 160.

At step 408, the replacement identifier 260 selects the audio device 150 that is connected to the selected port 162 of the managed switch 160. The replacement identifier 260 may select the audio device 150 that is connected to the selected port 162 of the managed switch 160 in any technically feasible fashion. For example, in some embodiments, the replacement identifier 260 performs a look up operation on the MAC address tables 245 included on the port mapping tables 250. Note that the selected port 162 of the managed switch 160 may not be connected to any of the audio devices 150. In such a scenario, at step 408, the replacement identifier 260 selects none of the audio devices 150. At step 410, the replacement identifier 260 determines whether any selected audio device 150 matches any of the new audio devices 150. If, at step 410, the replacement identifier 260 determines that the selected audio device 150 matches one of the new audio devices 150, then the method 400 proceeds to step 412.

At step 412, the replacement identifier 260 determines whether the hardware of the selected audio device 150 is compatible with the hardware of the failed audio device 150. The replacement identifier 260 may perform any number of comparison operations (including zero) in any combination and in any technically feasible fashion to determine whether the hardware of the selected audio device 150 is compatible with the hardware of the failed audio device 150. Further, the number and type of comparison operations may vary based on the type and/or functionality of the failed audio device 150. If, at step 414, the replacement identifier 260 determines that the hardware of the selected audio device 150 is compatible with hardware of the failed audio device 150, then the method 400 proceeds to step 416.

At step 416, the replacement identifier 260 sets the replacement audio device 150 for the failed audio device 150 to the selected audio device 150. The replacement identifier 260 may set the replacement audio device 150 in any technically feasible fashion. For example, in some embodiments, the replacement identifier 260 sets the replacement device identification 285 associated with the failed audio device 150 to specify the replacement audio device 150. In some embodiments, as part of step 416, the replacement identifier 260 updates the new device identifications 275 to remove the replacement audio device 150. The replacement identifier 260 then transmits the replacement device identification 285 to the replacement configurator 270 and the method 400 terminates.

If, however, at step 410, none of the audio devices 150 are selected or the selected audio device 150 does not match any of the new audio devices 150, then the method 400 proceeds directly to step 418. If, however, at step 414, the selected audio device 150 matches one of the new audio devices 150, but the hardware of the selected audio device 150 is not compatible with the failed audio device 150, then the method 400 proceeds directly to step 418.

At step 418, the replacement identifier 260 identifies the replacement audio device 150 for the failed audio device 150 based on an external source. The replacement identifier 260 may identify the replacement audio device 150 in any technically feasible fashion. For example, in some embodiments, the replacement identifier 260 transmits the failed device identification 265 and the new device identifications 275 to the system management engine 142 for display purposes. The system management engine 142 displays the failed device identification 165 and the new device identifications 275 and prompts the sound engineer or technician to select the replacement audio device 150 for the failed audio device 150. The system management engine 142 then transmits the corresponding replacement device identification 285 to the replacement identifier 260, the replacement identifier 260 relays the replacement device identification 285 to the replacement configurator 270, and the method 400 terminates.

In sum, the disclosed techniques enable an audio system to perform self-healing operations in response to audio device failures. The audio system includes multiple audio devices that are interconnected through managed switches, a system management engine, and a healing engine. In operation, the system management engine and the healing engine configure and control the audio devices using a communications protocol and a monitoring protocol. First, the system management engine enables a sound engineer to initialize the audio system. As part of the initialization phase, the system management engine configures each of the audio devices and transmits the configuration data associated with the audio devices to the healing engine. Upon receiving the configuration data, the healing engine stores the configuration data and configures the audio devices to notify the healing engine of changes to the configuration data. Further, the healing engine queries the managed switches to generate port mapping tables that map the media access control (MAC) addresses of the audio devices to the ports of the managed switches based on the monitoring protocol. Periodically, the healing engine re-queries the managed switches to update the port mapping tables and identify any changes to the connection status of the audio devices.

As the audio system operates, when any of the audio devices fail (e.g., are disconnected, cease to communicate, etc.), the healing engine detects and identifies the failed audio devices using the communications protocol. Using the communication protocol, the healing engine then detects and identifies any new audio devices that have been connected to the audio system since the failure. For each failed audio device, the healing engine selects the port of the managed switch to which the failed audio device was previously connected. If a new audio device is connected to the selected port and the healing engine establishes that the hardware configuration of the new audio device is compatible with the failed audio device, then the healing engine selects the new audio device as a replacement audio device. The healing engine configures the replacement audio device based on stored identification characteristics associated with the failed device, causing the replacement audio device to assume the identity of the failed audio device with respect to the audio system. Finally, the healing engine downloads any stored firmware and internal configuration associated with the failed audio device to the replacement audio device.

At least one advantage of the disclosed approaches is that the healing engine restores the audio system to a fully operational state after audio device failures more efficiently and robustly than manually-based repair techniques. In particular, by automatically identifying and configuring replacement audio devices, the healing engine minimizes the time that the audio system may be off-line or only partially operational. By contrast, conventional techniques rely on the availability, speed, and skill of humans to successfully restore the audio system to the fully operational state associated with the audio system immediately prior to audio device failures.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of audiovisual equipment and sensors, persons skilled in the art will appreciate that the systems and techniques described herein are applicable to other types of performance output devices (e.g., lasers, fog machines, etc.) and sensors. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A method for automatically repairing an audio system that includes a plurality of audio devices, the method comprising:

at a first time, detecting that a first audio device included in the plurality of audio devices has failed based on one or more automated monitoring operations;

at a second time that is later than the first time, detecting that one or more new audio devices have been added to the audio system;

selecting a second audio device included in the one of more new audio devices as a replacement for the first audio device; and configuring the second audio device to implement a system identity that is associated with the first audio device and the audio system by transmitting, to the second audio device, at least one of a firmware file and a parameter configured by a sound engineer.

2. The method of claim 1, further comprising prior to the first time, repeatedly storing updated configuration data associated with the first audio device.

3. The method of claim 1, wherein selecting the second audio device comprises:

prior to the first time, determining that the first audio device is connected to a first port of a managed switch; and at the second time, determining that the second audio device is connected to the first port.

4. The method of claim 3, further comprising verifying that the first audio device and the second audio device are hardware compatible.

5. The method of claim 3, wherein determining that the first audio device is connected to the first port comprises:

transmitting a connection status request to the managed switch; and in response, receiving a mapping between a first media access control (MAC) address associated with the first audio device and the first port.

6. The method of claim 5, wherein the connection status request is based on a Simple Network Management Protocol.

7. A non-transitory computer-readable storage medium including instructions that, when executed by a processor, automatically repairs an audio system that includes a plurality of audio devices by performing the steps of:

receiving first monitoring data that indicates that a first audio device included in the plurality of audio devices has failed at a first time;

receiving second monitoring data that indicates that one or more new audio devices have been added to the audio system at a second time that is later than the first time;

selecting a second audio device included in the one of more new audio devices as a replacement for the first audio device; and configuring the second audio device to replace the first audio device within the audio system by transmitting, to the second audio device, at least one of a firmware file and a parameter configured by a sound engineer.

8. The non-transitory computer-readable storage medium of claim 7, wherein configuring the second audio device comprises causing the second audio device to implement a system identity that is associated with the first audio device and the audio system.

9. The non-transitory computer-readable storage medium of claim 7, wherein selecting the second audio device comprises:

prior to the first time, determining that the first audio device is connected to a first port of a managed switch; and at the second time, determining that the second audio device is connected to the first port.

10. The non-transitory computer-readable storage medium of claim 9, further comprising verifying that the first audio device and the second audio device are hardware compatible.

11. The non-transitory computer-readable storage medium of claim 9, wherein determining that the first audio device is connected to the first port comprises:

transmitting a connection status request to the managed switch; and in response, receiving a mapping between a first media access control (MAC) address associated with the first audio device and the first port.

12. The non-transitory computer-readable storage medium of claim 7, wherein the first monitoring data indicates that the first audio device is not communicating to other audio devices included in the audio system.

13. The non-transitory computer-readable storage medium of claim 7, wherein the first monitoring data is received via either an Ethernet network protocol or a Universal Serial Bus protocol.

14. A system configured to automatically repair an audio system that includes a plurality of audio devices, the system comprising:

a memory storing a healing application; and a processor coupled to the memory, wherein, when executed by the processor, the healing application configures the processor to:

at a first time, determine that a first audio device included in the plurality of audio devices is not communicating with other audio devices included in the plurality of audio devices based on one or more automated monitoring operations;

at a second time that is later than the first time, determine that one or more new audio devices have been added to the audio system;

select a second audio device included in the one of more new audio devices as a replacement for the first audio device; and configure the second audio device to replace a functionality of the first device within the audio system by transmitting, to the second audio device, configuration data associated with the first audio device, wherein the configuration data includes at least one of a firmware file and a parameter configured by a sound engineer.

15. The system of claim 14, wherein the configuration data further includes a system identity that identifies the first audio device within the audio system.

16. The system of claim 14, wherein the healing application configures the processor to select the second audio device by:

prior to the first time, determining that the first audio device is connected to a first port of a managed switch; and at the second time, determining that the second audio device is connected to the first port.

17. The system of claim 16, wherein the healing application configures the processor to determine that the first audio device is connected to the first port by:

transmitting a connection status request to the managed switch; and in response, receiving a mapping between a first media access control (MAC) address associated with the first audio device and the first port.

* * * * *